US005751311A

United States Patent [19]

Drake

[11] Patent Number: 5,751,311

[45] Date of Patent: May 12, 1998

[54] HYBRID INK JET PRINTER WITH ALIGNMENT OF SCANNING PRINTHEADS TO PAGEWIDTH PRINTBAR

[75] Inventor: Donald J. Drake, Rochester, N.Y.

[73] Assignee: Xerox Corporation, Stamford, Conn.

[21] Appl. No.: 624,274

[22] Filed: Mar. 29, 1996

[51] Int. Cl.[6] ..... B41J 2/21

[52] U.S. Cl. ..... 347/43

[58] Field of Search ..... 347/12, 14, 19, 347/20, 24, 40, 42, 43

[56] References Cited

U.S. PATENT DOCUMENTS

| | | | |
|---|---|---|---|
| Re. 32,572 | 1/1988 | Hawkins et al. | 156/626 |
| 4,774,530 | 9/1988 | Hawkins | 346/149 R |
| 4,829,324 | 5/1989 | Drake et al. | 346/140 R |
| 4,999,077 | 3/1991 | Drake et al. | 156/299 |
| 5,057,859 | 10/1991 | Ishimaru | 354/400 |
| 5,099,256 | 3/1992 | Anderson | 346/1.1 |
| 5,136,305 | 8/1992 | Ims | 346/1.1 |
| 5,160,945 | 11/1992 | Drake | 346/140 R |
| 5,192,959 | 3/1993 | Drake et al. | 346/140 R |
| 5,198,054 | 3/1993 | Drake et al. | 156/64 |
| 5,221,397 | 6/1993 | Nystrom | 156/273.5 |
| 5,257,043 | 10/1993 | Kneezel | 346/140 R |
| 5,270,738 | 12/1993 | Takahashi et al. | 346/140 R |
| 5,280,308 | 1/1994 | Takahashi et al. | 346/134 |
| 5,343,227 | 8/1994 | Hirosawa et al. | 349/42 |
| 5,365,645 | 11/1994 | Walker et al. | 29/25.35 |
| 5,402,527 | 3/1995 | Bigby et al. | 395/101 |
| 5,534,895 | 7/1996 | Lindenfelser et al. | 347/19 |
| 5,581,284 | 12/1996 | Hermanson | 347/43 |
| 5,587,730 | 12/1996 | Karz | 347/43 |

*Primary Examiner*—Edward Tso

[57] ABSTRACT

An ink jet printer is configured in a hybrid architecture wherein a full width printbar is combined with a partial width color scanning assembly to provide the capability of selectively printing in black only or, alternately, into producing color prints by operating the color scanning assembly exclusively. The cost of the hybrid system, when compared to a full width color system using four full width printbars, is greatly reduced. The partial width scanning assembly is mounted on a carriage which is stepped along a printing swath width, the sum of the incremental scan steps equaling the width of a full width printbar. A dimensional mismatch between the printbar and the scanning printhead in the direction perpendicular to paper motion (width direction) could result in image degradation because of misalignment of color drops to black drops. The mismatch could result in manufacturing errors in either the printhead width and/or the width of the carriage. It is proposed to identify the total mismatch as a distance Δl prior to print operation and to adjust the incremental steps of carriage scan motion so as to change each incremental step by Δl divided by the number of steps. Thus, the mismatch is effectively spread over the entire print swath and does not become visually perceptible in the output image.

6 Claims, 2 Drawing Sheets

HYBRID INK JET PRINTER WITH ALIGNMENT OF SCANNING PRINTHEADS TO PAGEWIDTH PRINTBAR

BACKGROUND OF THE INVENTION AND MATERIAL DISCLOSURE STATEMENT

The present invention relates to ink jet printing and, more particularly, to a hybrid ink jet printer which combines a single black pagewidth array printbar with one or more partial width array scanning printheads for color printing.

Conventionally, most commercial ink jet printers are of the partial width array scanning type wherein a printhead module, typically one inch in width and containing a plurality of ink ejecting nozzles or jets, is mounted on a carriage which is moved in a scanning direction perpendicular to the path of motion of a recording medium such as paper. The printhead is in fluid communication with an ink supply cartridge. After each line scan by the printhead, the recording medium is advanced, and the printhead is scanned again across the medium. A black only scanning printer is disclosed, for example, in U.S. Pat. No. 5,136,305. For color printing, additional printhead modules and associated color ink jet cartridges are added to form a configuration of the type disclosed, for example, in U.S. Pat. No. 5,099,256, whose contents are hereby incorporated by reference. Printers such as the Xerox 4004, Canon Bubble Jet, and Hewlett Packard Desk Jet printers all use a scanning printhead architecture.

Pagewidth ink jet printers are known in the art which utilize one or more full width printbars. In these pagewidth printers, a full line recording head (printbar) is fixed in position adjacent to the path of the recording medium. Since there is no scan and re-scan time, a much higher print speed (on the order of 10:1) is enabled. One full width printbar may be used for a black only system; additional color printbars may be added to enable a highlight or full color printer.

U.S. Pat. Nos. 5,280,308, 5,343,227, and 5,270,738 disclose full color pagewidth printers with four recording printbars, black, cyan, magenta, and yellow.

Various methods are known for fabricating pagewidth printbars. One method is to form a pagewidth linear printbar by end-to-end abutment of fully functional printhead elements. U.S. Pat. Nos. 5,192,959, 4,999,077, and 5,198,054 disclose processes for forming linear printbars of butted subunits. An alternate method is to form printheads on both sides of a substrate in a staggered orientation and stitch together the outputs to produce a full width printbar. U.S. Pat. Nos. 4,829,324, 5,160,945, 5,057,859, and 5,257,043 disclose pagewidth printbars having two or more linear staggered arrays of printhead submodules.

A full width (12") array printbar which records at a resolution of 600 spi will typically have 7,200 nozzles or jets aligned linearly. For a full color printer with four full width printbars, 28,800 jets are in use.

A major consideration when designing a pagewidth color printer is the cost of the full width printbars which are typically order of magnitude higher than the cost of the smaller scanning array.

In U.S. Pat. No. 5,710,582, a hybrid color printer is disclosed which utilizes both a full width printbar and scanning partial width arrays to achieve a low printer cost. The contents of this application are hereby incorporated by reference.

One problem in hybrid printing systems of the type disclosed in the copending application referenced supra is the dimensional mismatch between the full width array and the partial width array scanning carriage in the direction perpendicular to the paper motion. This dimensional mismatch could result from either an error in the full width array length or from an error in the scanning printhead carriage dimension. The mismatch would be a deviation from the maximum imposed tolerance on this dimension. In either case, a misalignment of black drops to color drops exceeding a pixel in width can result in a degraded image.

SUMMARY OF THE INVENTION

It is, therefore, an object of the invention to compensate for dimensional mismatch between a full width printbar and a scanning printhead used in a hybrid printer architecture.

The object is accomplished, in a preferred embodiment, by first identifying the amounts of misalignment in a printer set up procedure and then adjusting the incremental scanning of the scanning printhead carriage to compensate for the identified misalignment.

More particularly, the present invention relates to a hybrid ink jet printer for recording images on a recording medium, during a printing swath, the printer comprising:

- a full width printbar for printing along the full width of said printing swath,
- a scanning assembly including at least two partial width color printheads,
- control means for selectively controlling a print operation to operate the full width printbar or the scanning assembly,
- drive means for driving said scanning assembly along said printing swath in a series of steps of a predetermined width,
- means for identifying a mismatch, $\Delta l$, between the width of the full width printbar and the summed width of the scanning series of steps, and for generating a signal representing said mismatch and
- wherein said control means contains circuitry for changing the average predetermined width of each of said series of steps by $\Delta$divided by the number of steps in the series.

DESCRIPTION OF THE INVENTION

Figure 1:
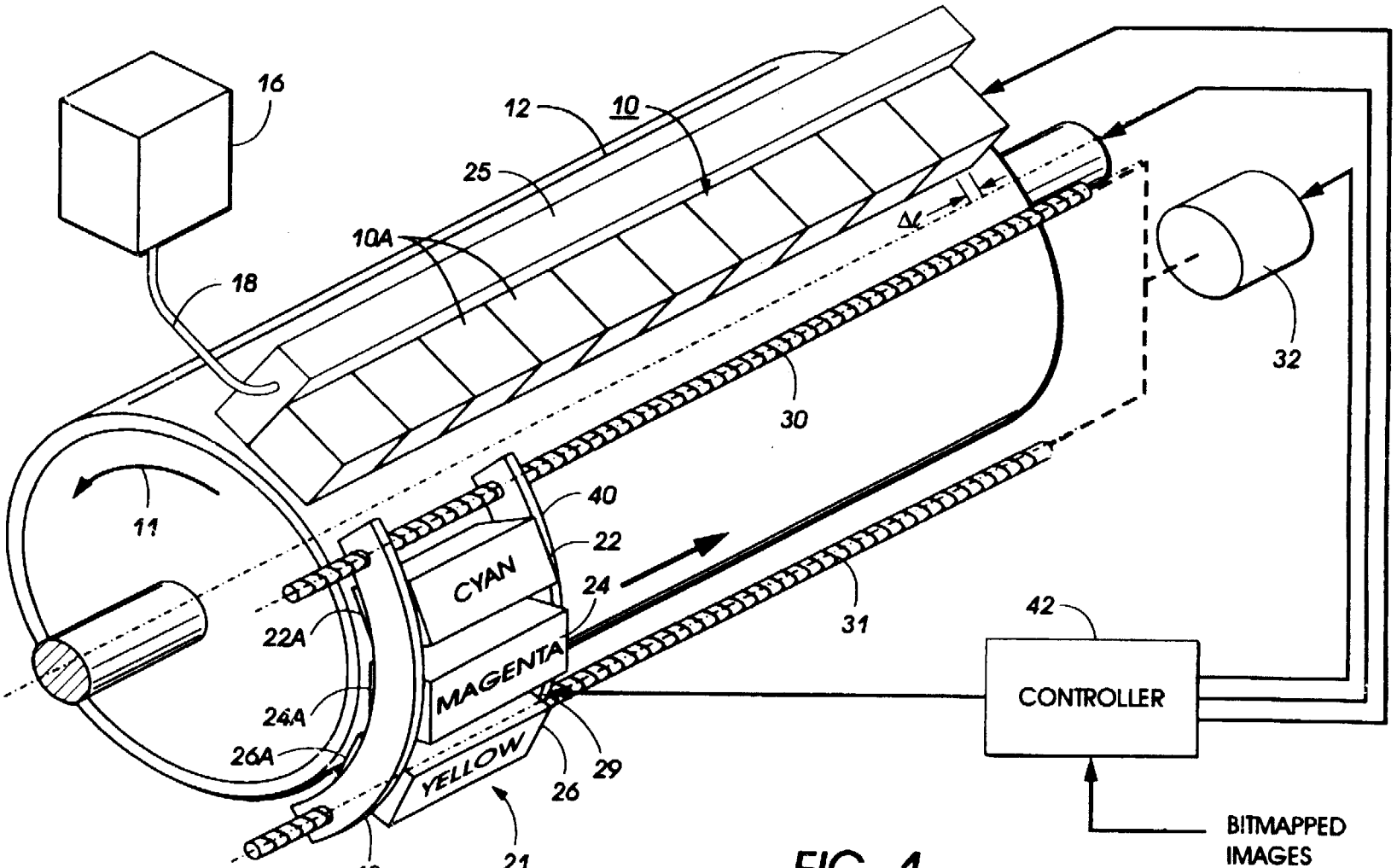
FIG. 1 is a partial frontal view of a hybrid color printer according to the invention incorporating a full width black printbar and a color scanning assembly incorporating three partial width color printheads.

FIG. 1 shows one embodiment of the invention wherein a hybrid printer 8 includes a full width black printbar 10 positioned to write on a curved recording medium (drum 12) which is indexed by a motor (not shown) and moves in the direction of arrow 11. Printbar 10 has been assembled from a plurality of modules 10A which have been butted together to form an extended width array according to the techniques described, for example, in U.S. Pat. No. 5,221,397, whose contents are hereby incorporated by reference. Printhead 10, in this embodiment, provides 7,200 nozzles or jets. As described in the '397 patent, the modules 10A are formed by butting together a channel array containing arrays of recesses that are used as sets of channels and associated ink reservoirs and a heater wafer containing heater elements and addressing circuitry. The bonded wafers are diced to form the printbar resulting in formation of the jets, each nozzle or jet associated with a channel with a heater therein. The heaters are selectively energized to heat the ink and expel an ink droplet from the associated jet. The ink channels are combined into a common ink manifold 25 mounted on the side of printhead 10 and in sealed communication with the ink inlets of the channel arrays through aligned openings. The manifold 25 is supplied with the appropriate ink, black for this embodiment, from an ink cartridge 16 via flexible tubing 18.

Also shown in FIG. 1, is a color printhead assembly 21 containing several ink supply cartridges 22, 24, 26 each with an integrally attached printheads 22A, 24A, 26A. Cartridge 22 supplies cyan ink to printhead 22A, cartridge 24 supplies magenta ink to printhead 24A, cartridge 26 supplies yellow ink to printhead 26A. Assembly 21 is removably mounted on a translatable carriage 29 which is driven along lead screws 30, 31 by drive motor 32. Carriage 29 comprises curved frame members 40, 42, the ends of which have threaded apertures through which lead screws 30, 31 are threaded. The carriage advances in the print (scan) direction incrementally to complete a printing swath following a predetermined number of incremental scan steps. The printheads 22A, 24A, 26A are conventional in construction and can be fabricated, for example, according to the techniques described in U.S. Pat. Nos. Re. 32,572 and 4,774,530, whose contents are hereby incorporated by reference.

Figure 2:
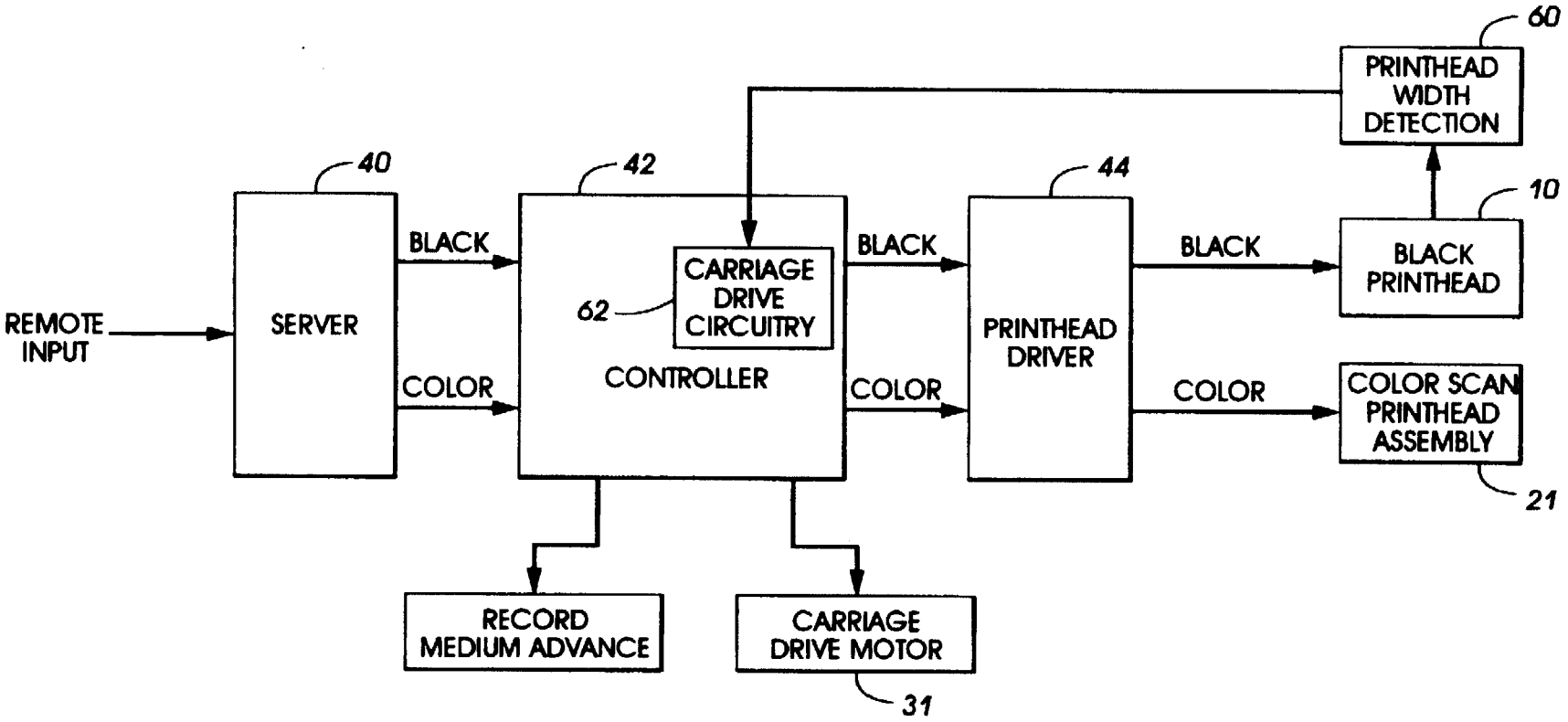
FIG. 2 is a schematic block diagram of the imaging and control system for operating the hybrid printer of FIG. 1 and for compensating for dimensional mismatch between the full width printbar and the scanning printheads.

The hybrid printer of FIG. 1 can be operated either as an all black printer by operating black pagewidth printbar 10 or as a color printer by operating color printhead assembly 21. The control system for selectively enabling an all black or a color mode of operation is shown in FIG. 2. FIG. 2 is a schematic diagram showing the processing of the data input drive signals for printer 10. Printer 8 can be, for this example, an element of a LAN system, although the hybrid printer of the invention can be used in other types of non-LAN systems.

Referring to FIG. 2, for purposes of description, it is assumed that an electronic document has been generated by a personal computer (PC) workstation and is to be printed by hybrid printer 8 over a LAN which includes a shared file server 40. It is further assumed that the remote input is written in Interpress™. Print server 40 functions as a "spooler" to buffer the jobs that are sent to it as well as a page description language (PDL) "decomposer" for converting the PDL file (for this case, Interpress™) to bitmaps consisting of pixel information for application to the printer. Each bitmap consists of bits representing pixel information in which each scan line contains information sufficient to print a single line of information across the width of medium 12. The Interpress™ standard for representing printed pages digitally is supported by a wide range of Xerox® Corporation products. Interpress™ instructions from a remote workstation are transformed into a format understood by the printer. The Interpress™ standard is comprehensive; it can represent any images that can be applied to paper (including complex graphics) and a wide variety of font styles and characters. Each page of an "Interpress™" master can be interpreted independently of others. Further details of operation of print servers operating in a LAN are found, for example, in U.S. Pat. No. 5,402,527, whose disclosure is hereby incorporated by reference.

Continuing with a description of FIG. 2, the output of server 40 are bitmapped files representing pages to be printed. The black and color output signals from server 40 are sent to controller 42. Controller 42 analyzes the bitmapped inputs and supplies the printhead drive signals to either the pagewidth printhead 10 or the color scanning printhead assembly 21 via printhead driver circuitry 44. The drive signals are conventionally applied via wire bonds to drive circuitry and logic on each module 10A and each printhead 22A–26A. Signals are pulsing signals which are applied to the heat generating resistors formed in the associated ink channels for each ink jet. Controller 42 may take the form of a microcomputer including a CPU, a ROM for storing complete programs, and a RAM. Controller 42 also controls other machine functions such as rotation of drum 12 and movement of the scanning carriage 29 by control of motor 32.

In a typical print operation, server 40 reads the header of the PDL page to determine whether any portion of the page is color. If the determination is that there is no color; e.g., that the page is simply all black text or graphics, the completely decomposed signal is sent via the controller to operate the pagewidth printbar 10 to print out at high speed the monochrome text. If the next page header read by server 40 indicates the presence of a color image, the decomposition time will be four times longer than the preceding black only page. The decomposed color image is sent via the controller to the driver 44 to drive the color printhead assembly 21. At least part of the longer decomposition time takes place during the monochrome printing of the preceding page enhancing the throughput. The PDL page header detection decomposition and relaying to the appropriate printhead is repeated until the entire document or page has been printed. It is seen that the printing throughput is increased to the maximum rate at which the printer can support.

For purposes of describing the invention, it will be assumed that printbar 10 has a nominal width of 20.32 cm, comprised of 10 modules 10A, each module having a width of 2.032 cm. It is further assumed that during fabrication of the modules, each module is fabricated with a width that exceeds the desired or designed width by 8 microns. Thus, each module is 2.032 cm+8 microns. The accumulative width of printhead 10 is, therefore, 20.32 cm+80 microns, or an 80 micron error.

Each color printhead 22A, 24A, 26A is 2.54 cm wide. Carriage 29 is stationary during printing and steps one-half the printhead width for a total of 16 steps to achieve a full printing swath of 20.32 cm. (An assumption is made that there is zero error in the swath width.) Thus, there exists a mismatch between the printing swath laid down by the printbar 10 (80 microns) with the printing swath of the assembly 21. The mismatch is identified as an incremental distance $\Delta$.

According to the invention, this mismatch is identified in a printhead width detection circuit 60 (FIG. 2) by a printer set up procedure or by a metrology step in manufacturing. As an example, the printbar 10 could have a bar code containing its dimensions which could be read by an encoder. Using a calibration pattern, a customer dials in the 80 micron compensation. Thus, the 80 micron error in the nominal width of printbar 10 is identified as $\Delta l$, and an electrical signal representing this error is sent to controller 42. Carriage drive circuitry 62 within the controller controls operation of the stepper carriage drive motor 32 and, hence, the path of carriage 21. The stepper motor is set to drive carriage 29 in 16 steps of 1.27 cm/step. Upon receiving a correction signal from circuit 60, circuit 62 adapts the step motor 32 output so that the stepper increments are averaged to create an overlap of 5 microns for each step (Δl/16). Thus, the total distance moved by the carriage matches the actual length of the printhead 10. The mismatch is spread over the entire page width which minimizes the visual perception degrading of the image due to the misalignment of black drops to color drops.

It is understood that the Δl could result in an error in the width of the carriage 29, or a combination of printbar width error and carriage width error. It will be apparent to one skilled in the art that there are a number of ways of determining the total misalignment in the scanning direction. It is also apparent that the mismatched Δl could be expressed in absolute units of width. It is further apparent that the scanned width could be other values; e.g., a full 12 inch width.

Further, while the invention contemplates operation in a thermal ink jet printer wherein resistors are selectively heated to causing ink ejection from an associated nozzle, the invention is also applicable to other types of ink jet printers such as, for example, piezoelectric printer of the type disclosed in U.S. Pat. No. 5,365,645, whose contents are hereby incorporated by reference. Also, while a full color assembly of three printheads was described, the scanning assembly can have fewer or greater printhead cartridges. As an example, if the printer is to operate in a highlight color mode, two printheads, one black and one selected color, may be used.

While the embodiments disclosed herein are preferred, it will be appreciated from this teaching that various alternative modifications, variations or improvements therein may be made by those skilled in the art which are intended to be encompassed by the following claims:

What is claimed is:

1. A hybrid ink jet printer for recording images on a recording medium, during a printing swath, the printer comprising:

a full width printbar for printing along the full width of said printing swath, a scanning assembly including at least two partial width color printheads, control means for selectively controlling a print operation to operate the full width printbar or the scanning assembly, drive means for driving said scanning assembly along said printing swath in a series of steps of a predetermined width, means for identifying a mismatch, Δl, between the width of the full width printhead and the summed width of the scanning series of steps, and for generating a signal representing said mismatch and wherein said control means contains circuitry for changing the average predetermined width of each of said series of steps by Δl divided by the number of steps in the series.

2. The printer of claim 1 wherein said mismatch Δl is due to an error in the width of the full width printbar and wherein said means for identifying the mismatch includes means for reading a bar code on said printbar representative of the width and sending an electrical signal representing said mismatch to scanning assembly drive means forming part of said control means.

3. The printer of claim 1 wherein said scan means includes a scanning carriage and wherein said scanning carriage is moved incrementally along the printing swath and wherein a mismatch is caused by an error in the design width of the carriage.

4. The printhead of claim 1 wherein the full width printbar includes a source of black ink and wherein the printbar records a black image onto the recording medium.

5. The printer of claim 4 wherein said partial width scan assembly includes a first printhead for printing cyan images and a second and third printhead for printing magenta and yellow images, respectively.

6. A method for compensating for a mismatch between a full width printbar and a scanning carriage having a plurality of partial width color printheads carried thereon, the mismatch caused by an error in the designed width of either the full width printhead or the carriage width, comprising the steps of a) determining the total width mismatched Δl between the full width printbar and the sum of the carriage scanning width, b) generating an electrical signal representing Δl, c) adjusting the incremental scanning carriage advance in the width direction such that each incremental advance is overlapped or underlapped as a function of Δl divided by the total number of scanning steps.

* * * * *